United States Patent [19]

Stewart, Jr.

[11] Patent Number: 4,482,148

[45] Date of Patent: Nov. 13, 1984

[54] VARIABLE-WIDTH FRICTION-FEED PAPER HANDLING APPARATUS

[75] Inventor: Robert T. Stewart, Jr., Verona, Va.

[73] Assignee: Genicom Corporation, Waynesboro, Va.

[21] Appl. No.: 371,533

[22] Filed: Apr. 26, 1982

[51] Int. Cl.[3] ..... B65H 5/04

[52] U.S. Cl. ..... 271/273; 226/179; 271/274

[58] Field of Search ..... 271/274, 273, 272, 240, 271/238, 253, 254, 255; 226/179, 185, 187, 199, 84

[56] References Cited

U.S. PATENT DOCUMENTS

| | | | |
|---|---|---|---|
| 2,871,011 | 1/1959 | Hercik | 226/179 |
| 4,030,726 | 6/1977 | Biedermann | 271/273 |

FOREIGN PATENT DOCUMENTS

| | | |
|---|---|---|
| 367804 | 2/1932 | United Kingdom . |
| 1122176 | 7/1968 | United Kingdom . |
| 2073154 | 10/1981 | United Kingdom . |

*Primary Examiner*—Douglas C. Butler
*Assistant Examiner*—John A. Carroll
*Attorney, Agent, or Firm*—Cushman, Darby & Cushman

[57] ABSTRACT

A variable-width friction-feed paper handling apparatus includes a rotatable drive shaft and a stabilizing shaft spaced therefrom and parallel thereto. Two carriage assemblies bridge the drive shaft and stabilizing shaft and are supported thereby and are adapted for sliding movement longitudinally therealong for accommodating varying widths of paper therebetween. Each carriage assembly includes a drive roller coaxial with the drive shaft for rotation thereby and a pivoting gate which rotatably carries a pressure roller, the gate being movable between a loading position accommodating placement of paper between the carriage assemblies and a feeding position wherein the pressure roller is in parallel cooperation with the drive roller frictionally to feed paper therebetween. Over-center springs hold the gate in its two positions and leaf springs resiliently mount the pressure roller. Each carriage assembly carries paper guide device.

21 Claims, 6 Drawing Figures

FIG. 4
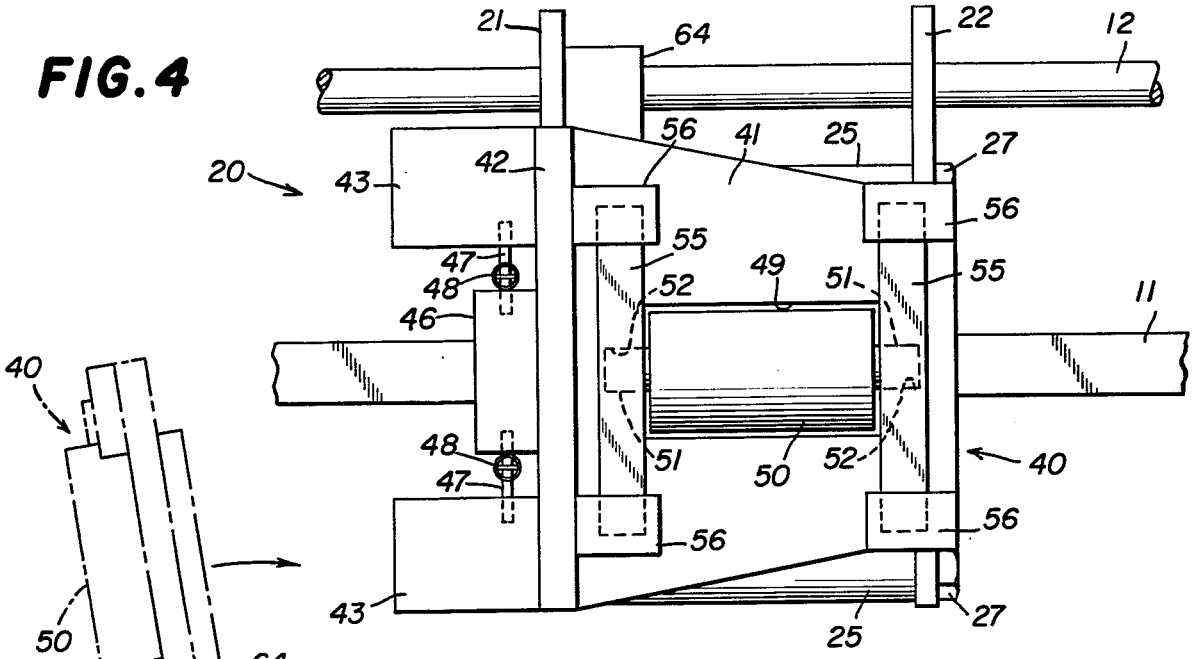
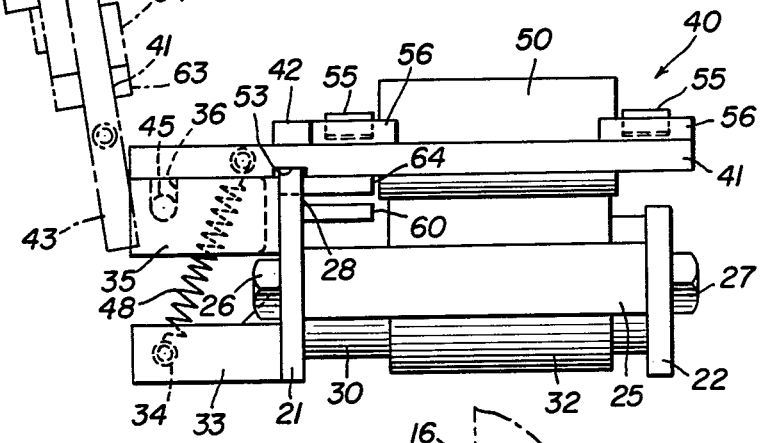
FIG. 5
FIG. 6
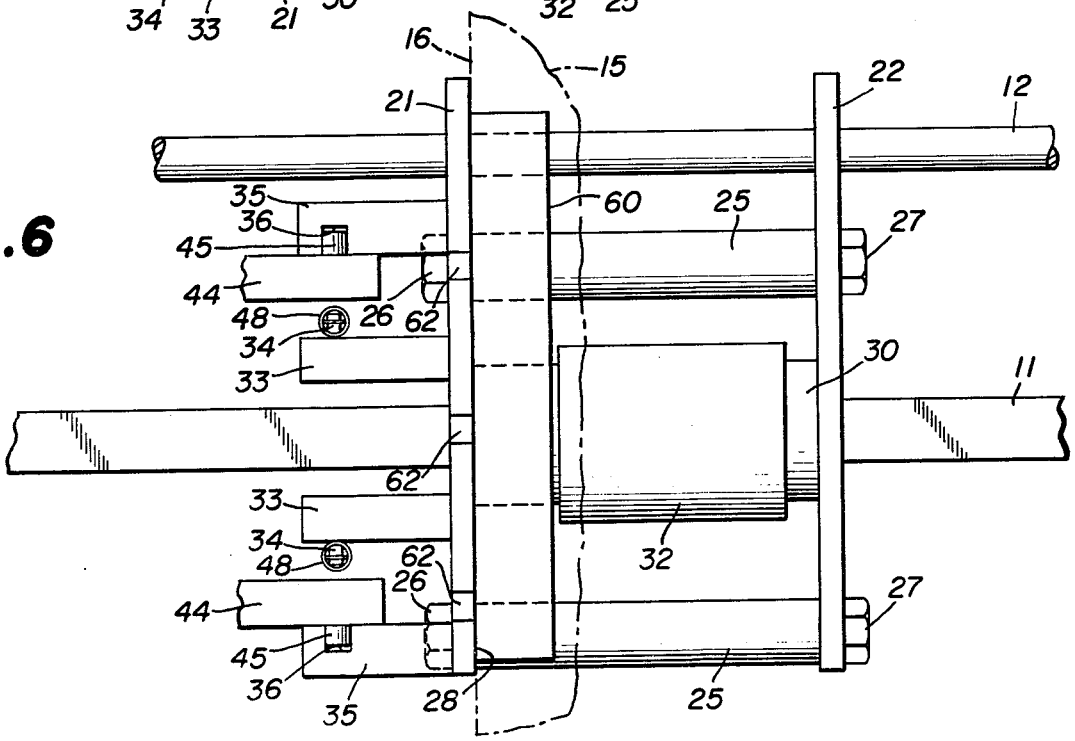

VARIABLE-WIDTH FRICTION-FEED PAPER HANDLING APPARATUS

BACKGROUND OF THE INVENTION

The present invention relates to paper handling apparatus, and particularly to paper feed mechanisms of the friction-feed type, such as feed apparatus for use in high speed printers and the like.

Prior friction feed devices have been able to accommodate only limited paper widths, numbers of paper parts and by poor paper loading through the device.

SUMMARY OF THE INVENTION

The present invention relates to an improved friction-feed paper handling apparatus which avoids the disadvantages of proper devices and affords additional structural and operating advantages.

It is an important object of this invention to provide a friction-feed paper handling apparatus which accommodates essentially unlimited variation of paper width and multiplicity of parts.

Another object of this invention is the provision of a friction-feed multi-part paper handling device of the type set forth, which permits easy loading of the paper into the device.

These and other objects of the invention are attained by providing a variable-width friction-feed paper handling apparatus for feeding paper in a predetermined feed direction, the apparatus comprising a rotatable drive shaft extending perpendicular to the feed direction, two carriage assemblies carried by the drive shaft and movable longitudinally therealong for accommodating varying widths of paper therebetween, each of the carriage assemblies including paper edge guiding, paper vertical constraining means, and feed means coupled to the drive shaft for operation thereby, said carriage assemblies shiftable between a loading condition accommodating placement of paper between the carriage assemblies and a feeding condition, each of the feed means in the feeding condition thereof being disposed for frictional engagement with the paper to effect longitudinal feeding thereof in the feed direction with minimum, undesirable lateral and vertical displacement.

The invention consists of these and other novel features and the combination of parts hereinafter fully described, illustrated in the accompanying drawings, and particularly pointed out in the appended claims, it being understood that various changes in the details may be made without departing from the spirit or sacrificing any of the advantages of the invention.

BRIEF DESCRIPTION OF THE DRAWINGS

FIG. 4 is an enlarged fragmentary top plan view of the left-hand one of the carriage assemblies illustrated in FIG. 1, illustrated in the feeding position but with no paper in place;

FIG. 5 is a front elevational view of the carriage assembly of FIG. 4, with the loading position illustrated in broken line; and FIG. 6 is a view similar to FIG. 4 with the carriage assembly illustrated in its loading position.

DESCRIPTION OF THE PREFERRED EMBODIMENT

Figure 1:
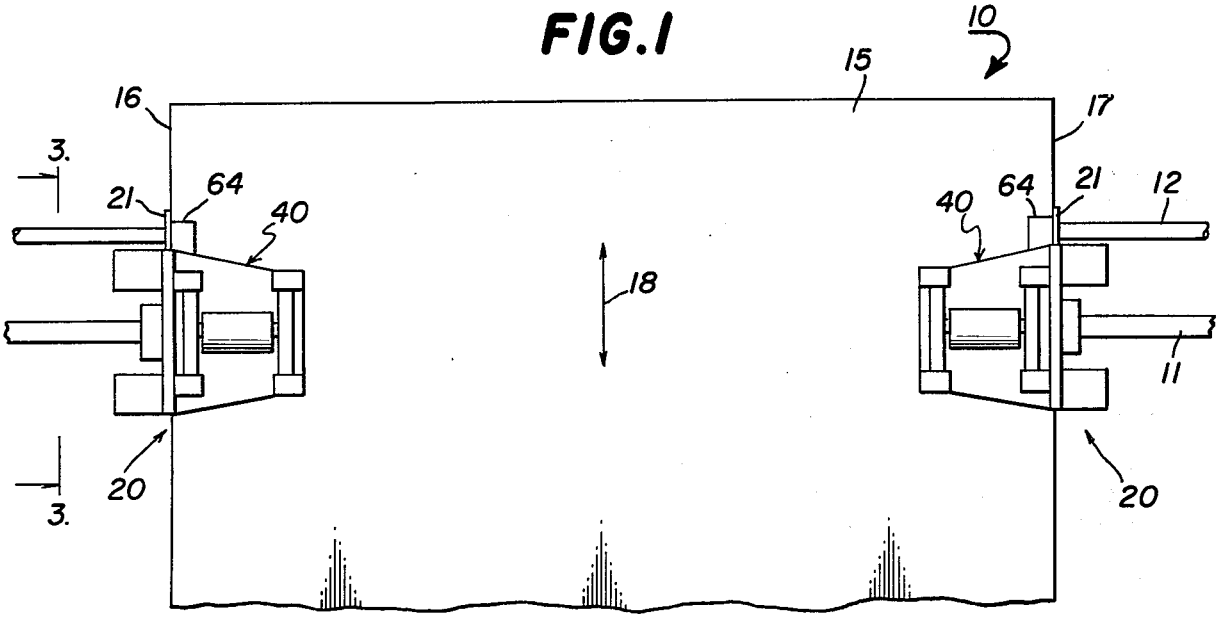
FIG. 1 is a fragmentary top plan view of the paper handling apparatus constructed in accordance with and embodying the features of the present invention, with the apparatus illustrated in the feeding position and with paper loaded therein.
Figure 2:
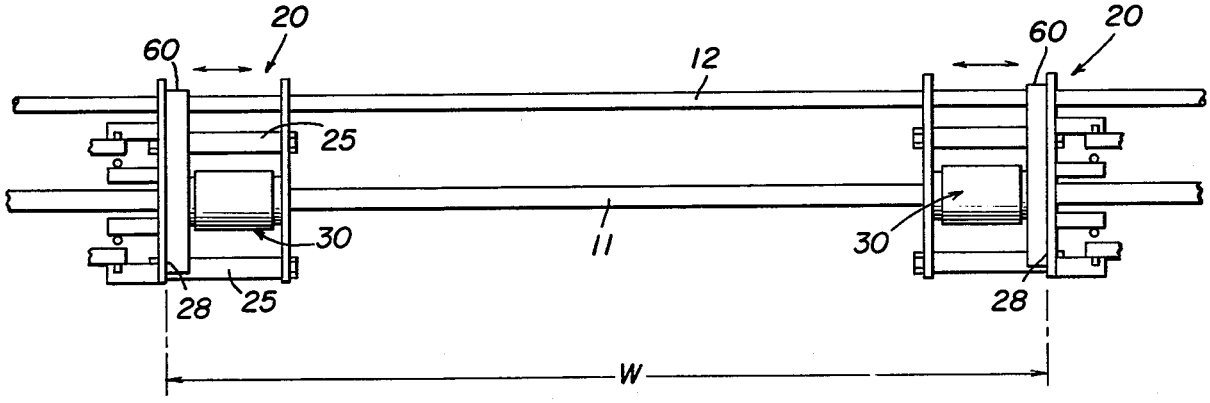
FIG. 2 is a view similar to FIG. 1, with the apparatus illustrated in its loading position prior to paper loading.
Figure 3:
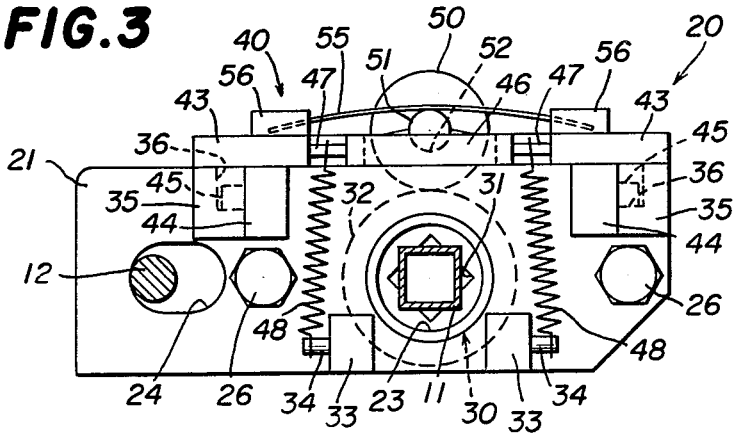
FIG. 3 is an enlarged side elevational view of one of the carriage assemblies of the paper handling apparatus, taken along the line 3—3 in FIG. 1.

Referring to FIGS. 1 and 2 of the drawings, there is illustrated a paper handling apparatus, generally designated by the numeral 10, constructed in accordance with and embodying the features of the present invention. The paper handling apparatus 10 includes a drive shaft 11, which in one embodiment was of square cross section (see FIG. 3) and a cylindrical stabilizing shaft 12 spaced from the drive shaft 11 and parallel thereto. The shafts 11 and 12 may be of any desired length, only portions of the shafts being illustrated in the drawings. The paper handling apparatus 10 will normally form a part of a device such as a printer and will operate to move a length of paper 15 through the printer. It will be understood that the drive shaft 11 is coupled to a suitable drive mechanism in the associated printer for effecting rotation of the drive shaft 11 about the longitudinal axis thereof. The paper handling apparatus 10 includes a pair of carriage assemblies, each generally designated by the numeral 20, arranged on the shafts 11 and 12 for respectively engaging the paper 15 adjacent to the opposite side edges 16 and 17 thereof for feeding the paper 15 in feed directions designated by the arrow 18 in FIG. 1.

The carriage assemblies 20 are constructed substantially as mirror images of each other and, therefore, only one will be described in detail.

Referring now also to FIGS. 3 through 6 of the drawings, each of the carriage assemblies 20 includes two laterally spaced-apart parallel side plates 21 and 22. Each of the side plates 21 and 22 has an aperture 23 therethrough (see FIG. 3) for accommodating the drive shaft 11 therethrough and an aperture 24 for accommodating the stabilizing shaft 12 therethrough. Disposed between the side plates 21 and 22 respectively on opposite sides of the drive shaft 11 are two cylindrical spacer tubes 25, respectively receiving bolts 26 therethrough which are threadedly engaged with nuts 27 for interconnecting the side plates 21 and 22 and maintaining the spacing therebetween. The outermost side plate 21, i.e., the side plate disposed toward the adjacent end of the drive shaft 11, extends upwardly a slight distance above the upper end of the side plate 22 and forms an edge guide or shoulder 28 on the inner side thereof (see FIGS. 5 and 6).

Also mounted between the side plates 21 and 22 is a cylindrical drive roller 30 having formed coaxially therethrough a bore 31 having, in one embodiment, a transverse cross section generally in the shape of an eight-pointed star and adapted for receiving the drive shaft 11 therethrough (see FIG. 3), thereby to key the drive roller 30 onto the drive shaft 11 for rotation therewith. The drive roller 30 carries a friction sleeve 32 therearound. Integral with the side plate 21 and extending outwardly therefrom on opposite sides of the drive shaft 11 and substantially parallel thereto are two anchor projections 33, each having a laterally outwardly projecting anchor lug 34 for a purpose to be explained more fully below. Integral with the side plate 21 and respectively outboard of the anchor projections 33 are the two pivot projections 35, each having a pivot notch 36 formed on the inner surface thereof at the upper end thereof.

The carriage assembly 20 also includes a gate assembly, generally designated by the numeral 40, which includes a flat plate 41 dimensioned to span the side plates 21 and 22 and provided along one side edge thereof with an upstanding rectangular rib 42. Integral with the rib 42 and projecting outwardly therefrom away from the plate 41 and substantially coplanar therewith are two mounting flanges 43 respectively disposed on opposite sides of the drive shaft 11. Each of the mounting flanges 43 is provided with a depending mounting leg 44, each leg 44 being provided with a laterally outwardly projecting pivot lug 45 adapted to be received in the corresponding one of the pivot notches 36 for pivotal mounting of the gate assembly 40. Also integral with the rib 42 between the mounting flanges 43 is a rectangular tab 46, the opposite ends of which are respectively connected to the mounting flanges 43 by pins 47. The carriage assembly 40 is also provided with two helical tension springs 48, respectively having the upper ends thereof coupled to the pins 47 and having the lower ends thereof coupled to the anchor lugs 34.

Formed in the plate 41 is an aperture 49 (see FIG. 4) receiving therein a cylindrical pressure roller 50. The pressure roller 50 is rotatably carried on a coaxial shaft 51, the opposite ends of which project outwardly beyond the ends of the pressure roller 50 and are respectively received in bearing recesses 52 formed in the upper surface of the plate 41. Respectively overlying the ends of the shaft 51 seated in the recesses 52 are two leaf springs 55, the opposite ends of which are respectively trapped in anchor blocks 56 formed on the upper surface of the plate 41. The leaf springs 55 cooperate resiliently to hold the pressure roller shaft 51 in place in the bearing recesses 52 and bias the pressure roller towards the drive roller 30 when the gate assembly is in a closed or feeding position.

It will be appreciated that the gate assembly 40 is pivotally movable between an open or loading position, illustrated in broken line in FIG. 5, and a closed or feeding position, illustrated in solid line in FIGS. 4 and 5. The underside of the plate 41 has formed therein an elongated notch or recess for accommodating the upper edge of the side plate 21 when the gate assembly 40 is disposed in its feeding position. The anchor lugs 34 are disposed in a common vertical plane with the pivot lugs 45, whereas the pins 47 are positioned as that, in the loading position of the gate assembly 40, they will be disposed on one side of that plane, while in the feeding position of the gate assembly 40 they will be disposed on the other side of that plane. Accordingly, it will be appreciated that the springs 48 act as over-center springs resiliently to hold the gate assembly 40 and each of its loading and feeding positions.

When single part, and more particularly multi-part paper is being fed, a problem oftentimes arises wherein the paper in passing past the drive mechanism weaves undesirably in the lateral direction and at times wrinkles or buckles, resulting in non-uniform printing or paper jamming. The present invention substantially overcomes these problems as shown in FIGS. 5 and 6. Referring to FIG. 6, a paper platform 60 is shown formed as a part of side plate 21. Platform 60 has extending from it a vertical shoulder 28 serving as an edge guide to restrict lateral paper motion as the paper 16 is driven by roller 30 in conjunction with roller 50. Notches 62 are formed in the shoulder 28 and adapted to receive projections 63 formed in plate 41 when the hinge assembly is in its closed or feeding position. This arrangement prevents paper from rising above and over the shoulder 28 thereby insuring proper paper alignment during its passage past a printing station. A further platform 64 carried on plate 41 is dimensioned and located such that when the hinge assembly is in its closed position or feeding position, the platform 64 mates with platform 60 to within a predetermined gap or spacing as shown in FIG. 5. The paper, including in multi-part form, is thus restricted in its vertical displacement to within the spacing between platforms 60 and 64, and is restricted in its lateral displacement by shoulder 28 and by the notches and projections 62 and 63 respectively. The platforms 60 and 64 are dimensioned to extend in the paper feeding direction for a substantial distance and that, coupled with the spacing provided between platforms 60 and 64, substantially increases the beam strength or stiffness of the edge of the paper abutting edge guide 28 thus insuring proper edge guiding and therefore registration of the paper without undesirable wrinkles or buckles as the paper is driven past the print station.

In operation, the carriage assemblies 20 are slid longitudinally along the shafts 11 and 12 until they are spaced apart the desired distance for accommodating the width of paper to be used. A significant aspect of the present invention is that the paper handling apparatus 10 is variable among an infinite number of paper widths, the maximum width being limited by the length of the shafts 11 and 12. When the carriage assemblies 20 have been placed in the desired position, the gate assemblies 40 are provided upwardly to their open or loading positions. In this position, the paper 15 can easily be placed between the carriage assemblies 20 over the drive rollers 30, with the opposite side edges 16 and 17 of the paper 15 being respectively disposed for guiding engagement with the edge guide 28 of the carriage assemblies 20. When the paper 15 is thus positioned in place, the gate assemblies 40 are pivoted back down to their closed or feeding positions. It can be seen that in these feeding positions, the feed rollers 30 and the pressure rollers 50 cooperate frictionally to engage the paper 15 therebetween respectively adjacent to the opposite side edges 16 and 17 thereof, this frictional gripping pressure being maintained by the springs 48. As the drive shaft 11 is rotated, the drive rollers 30 will also be rotated for frictionally feeding the paper 15 in directions indicated by the arrow 18 with proper edge guiding being achieved with the combination of platforms 60 and 64, edge guide 28 and notches and projections 62 and 63 extending from platforms 60 and 64 respectively. The leaf springs 55 will permit slight upward movement of the pressure rollers 50 to accommodate different thicknesses of paper between the pressure rollers 50 and the drive rollers 30.

From the foregoing, it can be seen that there has been provided an improved paper handling apparatus of the friction-feed variety which permits essentially unlimited variation of the paper width and which provides simple and easy loading of the paper into the apparatus.

What I claim as new and desire to secure by Letters Patent of the United States is:

1. A variable-width friction-feed paper handling apparatus for feeding paper in a predetermined feed direction, said apparatus comprising:

a rotatable drive shaft extending perpendicular to the feed direction, two carriage assemblies, paper edge-guiding means carried by each of said carriage assemblies for providing paper edge guiding to minimize undesirable paper buckling, said carriage assemblies being carried by said drive shaft and movable longitudinally therealong for accommodating varying widths of paper between respective edge guides thereof, each of said carriage assemblies including paper feed means with a drive roller coupled to said drive shaft for operation thereby and also including a gate means having a pressure roller rotatably mounted therein with the entire gate means being rotationally shiftable about a transverse pivot axis with respect to said drive roller between a loading condition which completely exposes said drive roller thereby accommodating placement of paper between said carriage assemblies and a spring-biased feeding condition which places said pressure roller directly over and parallel to said drive roller and spring biased toward said drive roller in the feeding condition for frictional engagement with the paper to effect frictional feeding of the paper in the feed direction.

2. A variable-width friction-feed paper handling apparatus for feeding paper in a predetermined feed direction, said apparatus comprising:

a rotatable drive shaft extending perpendicular to the feed direction, two carriage assemblies, means within each of said carriage assemblies for providing paper edge guiding to minimize undesirable paper buckling including a paper edge guiding means, said carriage assemblies being carried by said drive shaft and movable longitudinally therealong for accommodating varying widths of paper between respective edge guides thereof, each of said carriage assemblies including paper feed means coupled to said drive shaft for operation thereby and shiftable between a loading condition accommodating placement of paper between said carriage assemblies and a feeding condition, each of said paper feed means in the feeding condition thereof being disposed for frictional engagement with the paper to effect frictional feeding thereof in the feed direction; and wherein each of said edge guiding means comprises a pair of spaced apart paper platforms extending in the direction of paper feeding with interlocking notches and projections spaced therefrom in said direction.

3. The paper handling apparatus of claim 2, wherein said two paper feed means in the feeding condition thereof engage the paper along a common plane parallel to said drive shaft.

4. The paper handling apparatus of claim 2, wherein said carriage assemblies are adapted for sliding movement along said drive shaft.

5. The paper handling apparatus of claim 2, wherein each of said carriage assemblies includes guide means engageable with an adjacent side edge of the paper for guiding thereof.

6. The paper handling apparatus of claim 2, wherein each of said carriage assemblies includes bias means for resiliently holding said feed means in its loading condition and in its feeding condition.

7. A variable-width friction-feed paper handling apparatus for feeding paper in a predetermined feed direction, said apparatus comprising:

a rotatable drive shaft extending perpendicular to the feed direction, two carriage assemblies carried by said drift shaft and movable longitudinally therealong for accommodating varying widths of paper therebetween, each of said carriage assemblies including a drive roller and a pressure roller having parallel longitudinal axes in a feeding position, said drive rollers being coupled to said drive shaft for rotation thereby about common longitudinal axes perpendicular to the paper feed direction, said pressure rollers also each being rotationably movable about a pivot axis that is transverse to their respective longitudinal axes between a loading position where the longitudinal axis of the pressure roller is transverse to that of its drive roller thereby completely exposing the drive roller and thus accommodating placement of paper between said carriage assemblies and said feeding position, each of said pressure rollers in the feeding position thereof being disposed for rotation about an axis parallel to the axis of said drive rollers and for parallel frictional cooperation with the associated one of said drive rollers frictionally to feed paper therebetween in the feed direction.

8. The paper handling apparatus of claim 7, and further including a stabilizing shaft parallel to said drive shaft and spaced therefrom, each of said carriage assemblies bridging said drive shaft and said stabilizing shaft and being supported thereby.

9. The paper handling apparatus of claim 7, wherein said pressure rollers are disposed substantially coaxially in the feeding positions thereof.

10. The paper handling apparatus of claim 7, wherein said drive rollers are disposed coaxially with said drive shaft.

11. The paper handling apparatus of claim 7, wherein each of said carriage assemblies further includes edge guiding means engageable with the adjacent edge of the paper for guiding thereof.

12. The paper handling apparatus of claim 7, wherein each of said carriage assemblies includes bias means resiliently holding the associated pressure roller in its loading position and in its feeding position.

13. A variable-width friction-feed paper handling apparatus for feeding paper in a predetermined feed direction, said apparatus comprising:

a rotatable drive shaft extending perpendicular to the feed direction; and two carriage assemblies carried by said drive shaft and movable longitudinally therealong for accommodating varying widths of paper therebetween;

each of said carriage assemblies including a drive roller coupled to said drive shaft for rotation thereby about a longitudinal axis perpendicular to the paper feed direction, a gate means mounted for transverse pivotal movement with respect to the longitudinal axis of said drive roller between a loading position completely exposing the drive roller and thus accommodating placement of paper between said carriage assemblies and a feeding position, and a pressure roller rotatably carried by said gate means and movable therewith, said pressure roller being disposed for parallel frictional cooperation with said drive roller frictionally to feed paper therebetween in the feed direction when said gate means is disposed in the feeding position thereof.

14. A variable-width friction-feed paper handling apparatus for feeding paper in a predetermined feed direction, said apparatus comprising:

a rotatable drive shaft extending perpendicular to the feed direction; and two carriage assemblies carried by said drive shaft and movable longitudinally therealong for accommodating varying widths of paper therebetween;

each of said carriage assemblies including a drive roller coupled to said drive shaft for rotation thereby about an axis perpendicular to the paper feed direction, a gate means mounted for pivotal movement with respect to said drive roller between a loading position accommodating placement of paper between said carriage assemblies and a feeding position, and a pressure roller rotatably carried by said gate means and movable therewith, said pressure roller being disposed for parallel frictional cooperation with said drive roller frictionally to feed paper therebetween in the feed direction when said gate means is disposed in the feeding position thereof;

wherein each of said gate means includes a first paper platform, each of said assemblies including a second paper platform, said second platform including a paper edge guide, notches formed in said edge guide, projections formed on said first platform, each of said first platforms mating with a respective second platform during feeding position with the projections of the first platform engaging with the notches of the edge guide of a second platform.

15. The paper handling apparatus of claim 14, wherein each of said gate means is pivotally movable about an axis disposed perpendicular to the axis of said drive shaft.

16. The paper handling apparatus of claim 14, wherein each of said pressure rollers has a shaft projecting from the opposite ends thereof, each of said gate means including seat means receiving the ends of the shaft of the associated pressure roller.

17. The paper handling apparaus of claim 16, wherein each of said gate means further comprises means for permitting positive and parallel engagement of the pressure and drive rollers, said last means comprising bias means resiliently holding the shaft of the associated pressure roller in said seat means.

18. The paper handling apparatus of claim 17, wherein said bias means includes two leaf springs respectively resiliently engaging the opposite ends of the pressure roller shaft.

19. The paper handling apparatus of claim 14, wherein each of said carriage assemblies includes bias means resiliently holding said gate means in the loading position thereof and in the feeding position thereof.

20. The paper handling apparatus of claim 19, wherein said bias means includes an over-center spring.

21. The paper handling apparatus of claim 14, wherein each of said carriage assemblies includes paper guide means engageable with the adjacent edge of the paper for guiding thereof.

* * * * *